United States Patent [19]

Plummer

[11] Patent Number: 4,884,752

[45] Date of Patent: Dec. 5, 1989

[54] ELECTROSTATIC PAINT SPRAY SYSTEM WITH DUAL VOLTAGE ISOLATING PAINT RESERVOIRS

[75] Inventor: Raymond G. Plummer, Toledo, Ohio

[73] Assignee: The De31ilbiss Company, Toledo, Ohio

[21] Appl. No.: 283,871

[22] Filed: Dec. 13, 1988

Related U.S. Application Data

[63] Continuation-in-part of Ser. No. 122,312, Nov. 18, 1987, Pat. No. 4,792,092.

[51] Int. Cl.[4] ..... B05B 5/02; B05B 15/02

[52] U.S. Cl. ..... 239/691; 239/112; 239/305

[58] Field of Search ..... 239/305, 310, 690, 691, 239/704–708, 112; 138/111

[56] References Cited

U.S. PATENT DOCUMENTS

| | | | |
|---|---|---|---|
| 2,784,350 | 3/1957 | Sedlacsik | 239/704 |
| 4,139,155 | 2/1979 | Hastings | 239/708 |
| 4,232,055 | 11/1980 | Shaffer | 239/305 X |
| 4,597,534 | 7/1986 | Ruud | 239/704 |
| 4,728,034 | 3/1988 | Matsumura et al. | 239/112 |

FOREIGN PATENT DOCUMENTS

| | | | |
|---|---|---|---|
| 684276 | 4/1964 | Canada | 138/111 |
| 1920027 | 11/1969 | Fed. Rep. of Germany | 138/111 |
| 676224 | 7/1952 | United Kingdom | 138/111 |
| 2276 | 4/1987 | World Int. Prop. O. | 239/706 |

*Primary Examiner*—Andres Kashnikow

*Attorney, Agent, or Firm*—MacMillan, Sobanski & Todd

[57] ABSTRACT

Dual voltage isolating paint reservoirs for an electrostatic color change paint spray system. The reservoirs are formed from electrically insulated tubes which are wound into helices of different diameters and coaxially positioned to occupy the space otherwise occupied by a single helical reservoir tube.

3 Claims, 2 Drawing Sheets

ELECTROSTATIC PAINT SPRAY SYSTEM WITH DUAL VOLTAGE ISOLATING PAINT RESERVOIRS

Cross-Reference To Related Application

This application is a continuation-in-part of copending U.S. patent application Ser. No. 07/122,312 filed Nov. 18, 1987.

TECHNICAL FIELD

This invention relates to electrostatic coating and more particularly to improved dual voltage isolating paint reservoirs for use in selectively applying different color water based and other electrically conductive paints from an electrostatic paint spray system.

BACKGROUND ART

For economical and environmental reasons, water based paints are increasingly used in industrial production applications. For high transfer efficiency, the coatings are often applied by means of electrostatic spray guns. Water based paints present problems with electrostatic applicators due to their electrical conductivity. In manufacturing production lines, it is sometimes desirable to have an electrically isolating paint color change system for selectively supplying different color electrically conductive paints to an electrostatic applicator. In early color change systems of this type, the entire paint delivery system from the supply tanks for the different color paints to the spray gun was electrically isolated from ground. In other systems, only the colored paint currently supplied to the spray gun was isolated from ground. This arrangement was not very acceptable because of the large mass which had to be maintained at the high voltage. The capacitance of the large mass stored a large amount of electrical energy which could produce a high energy discharge if a grounded object was brought near the spray gun. Also, there was a risk to personnel in the area because of the large system which typically was charged from 50,000 volts to over 100,000 volts.

Another approach was to provide an electrically isolated reservoir which held a charge of the paint currently be applied. Either the reservoir was filled while the high voltage was interrupted or a voltage block was provided between the supply tanks and the isolated reservoir. This was accomplished, for example, by dripping the paint into the reservoir to interrupt the electrical path through the paint supply tank to ground. Neither of these arrangements permitted rapid color change.

DISCLOSURE OF INVENTION

One type of voltage block color change system suitable for water based and other electrically conductive paints involves the use of two relatively small isolated paint reservoirs. Prior to application, a quantity of paint is charged into a reservoir from a grounded paint supply tank while the reservoir is isolated from the high voltage system. While paint is subsequently supplied from that reservoir to the electrostatic applicator, e.g., an electrostatic spray gun, the other reservoir is isolated from the high voltage, cleaned and charged with the next color paint. In a preferred embodiment of this type of color change system, the reservoirs are in the form of an electrically insulating plastic tube wound into a helix. A system of this type can require a relatively large space for the two reservoirs either in or immediately adjacent the spray booth where the paint is applied. It is preferable to minimize the length of the tube or hose supplying paint from the reservoir to the application to facilitate rapid purging of the tube after coating with a particular color is completed. However, the tube or hose must have sufficient length to provide electrical insulation between the high voltage at the applicator and the reservoir during color change.

According to the invention, dual helical reservoir tubes for an electrically isolating color change system are coaxially arranged. The reservoir tubes are wound about a vertical axis so the paint will flow to an outlet at the lower end of each tube as the paint is consumed. The tubes are formed as different diameter helices and are mounted with one reservoir tube located inside of the other reservoir tube for the most compact arrangement. Although the two reservoirs are mounted adjacent to one another, the material forming the reservoir tubes provides electrical insulation between the reservoirs so that one reservoir may be subjected to a high voltage while paint is applied from such reservoir and, at the same time, the adjacent reservoir may be grounded while it is cleaned and charged with the next color paint.

Accordingly, it is an object of the invention to provide improved dual voltage isolating paint reservoirs suitable for use in an electrostatic paint color change spray system of a type capable of applying electrically conductive paints.

BEST MODE FOR CARRYING OUT THE INVENTION

Figure 1:
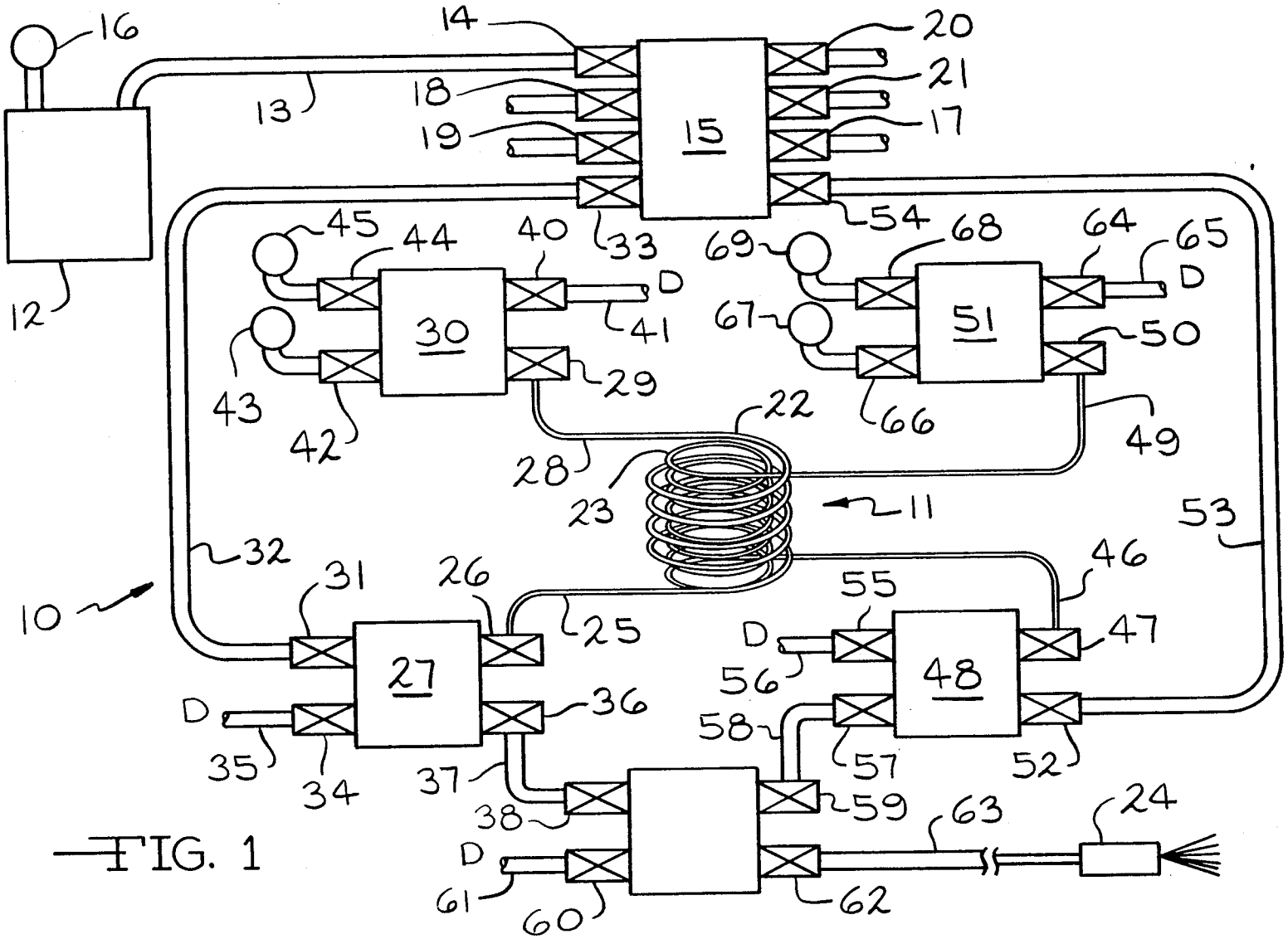
FIG. 1 is a diagrammatic block diagram of a color change system suitable for supplying an electrically conductive paint to an electrostatic paint spray applicator incorporating dual helical paint reservoir according to the invention.

Referring to FIG. 1 of the drawings, a schematic block diagram is shown for an exemplary paint color change system 10 capable of use with electrically conductive paints is shown with an improved voltage isolating dual paint reservoir 11 according to the invention. A paint source, such as a tank 12, is connected through a hose 13 to a valve 14 on a color selection manifold 15. The tank 12 may be sealed and a source of compressed air 16 may be connected to the tank 12 to cause paint to flow from the tank 12 to the manifold 15 when the valve 14 is opened. Or, a pump (not shown) can be located in the hose 13 for causing paint to flow under pressure from the tank 12 to the manifold 15. Several other valves on the color selection manifold 15, valves 17, 18 and 19 are shown, are connected to pressurized sources (not shown) of other color paint. The manifold 15 also has a valve 20 connected to a source of solvent (not shown) and a valve 21 connected to a source of compressed air (not shown). When the paint is of the water based type, the solvent may be water. All of the paint sources and the color selection manifold 15 are always at ground potential.

During coating of a workpiece, paint is delivered from one of two tubular fluid reservoirs 22 or 23 to an electrostatic spray gun 24. The reservoirs 22 and 23 are each in the form of an electrically insulated tube wound in a helical coil about a vertical axis. The internal diameter of the tube and the length of the tube preferably are selected to hold at least the volume of paint required to coat the largest workpiece to be coated by the system 10. Using tubes for the reservoirs 22 and 23 has several advantages over the use of conventional reservoir tanks. Less coating material will remain in the tube upon completion of a coating cycle and the tube is more readily purged of paint and dried during a color change cycle.

The reservoir 22 has a lower end 25 connected to a valve 26 on a first mode selection manifold 27 and has an upper end 28 connected to a valve 29 on a second mode selection manifold 30. The first mode selection manifold 27 also has a valve 31 connected through a hose 32 to a valve 33 on the color selection manifold 15, a valve 34 connected through a hose 35 to a suitable waste dump container (not shown) and a valve 36 connected through a hose 37 to a valve 38 on a coil selection manifold 39. The second mode selection manifold 30 also has a valve 40 connected through a hose 41 to the dump container, a valve 42 connected to a vent 43 and a valve 44 connected to a compressed air source 45. However, it should be appreciated that the dump valve and the vent valve may be the same with a single hose serving both dump and vent functions.

The reservoir 23 is similarly arranged, having a lower end 46 connected to a valve 47 on a first mode selection manifold 48 and an upper end 49 connected to a valve 50 on a second mode selection manifold 51. The first mode selection manifold 48 also is connected through a valve 52 and a hose 53 to a valve 54 on the color selection manifold 15, is connected through a valve 55 and a hose 56 to the dump container and is connected through a valve 57 and a hose 58 to a valve 59 on the coil selection manifold 39. The coil selection manifold 39 is connected through a valve 60 and a hose 61 to the dump container and is connected through a valve 62 and a hose 63 to the spray gun 24. The second mode selection manifold 51 is connected through a valve 64 and a hose 65 to the dump container, through a valve 66 to a vent 67 and through a valve 68 to a compressed air source 69.

Voltage isolation between the first mode selection manifolds 27 and 48 and the grounded color selection manifold 15 is achieved by using electrically insulated hoses 32 and 53, respectively, to form voltage blocks between the manifolds 27 and 48 and the color selection manifold 15. Voltage isolation between the two reservoirs 22 and 23 and between the reservoirs 22 and 23 and the spray gun 24 is achieved by the electrically insulated hoses 37 and 58 between the first mode selection manifolds 27 and 4, respectively, and the coil selection manifold 39. Also, all of the hoses 35, 41, 56, 61 and 65 connected to the dump container are made from an electrically insulated material. An electrical connection is present through a hose only so long as an electrically conductive liquid is present in a hose. A voltage barrier or block will be present across a hose whenever paint is purged from such hose and the hose is dried.

The system 10 is operated under the control of a conventional programmable controller (not shown) which is programmed to control the operating sequence and open times for the various valves and to operate a trigger valve in the spray gun 24. In operation, all hoses in the system 10 between the color selection manifold 15 and the spray gun 24 initially will be clean and dry. One of the color valves on the manifold 15, valve 14, for example, and one of the coil selection valves, valve 33, for example, will be opened to connect the pressurized paint source 12 to the hose 32. The valves 31 and 26 on the first mode selection manifold 27 will be opened to complete the connection from the paint source 12 to the lower reservoir end 25. At the same time, the valves 29 and 42 are opened to vent the upper end 28 of the reservoir 22. The valves remain open until a desired quantity of paint flows into the reservoir 22, whereupon the valves 14 and 26 are closed. The valve 14 may be closed when the paint remaining in the hose 32 is sufficient to complete the desired quantity of paint and the air valve 21 is opened to provide air pressure to push the remaining paint from the hose 32 into the reservoir 22. After the valve 26 is closed, the dump valve 34 is opened and the solvent valve 20 and the air valve 21 are pulsed to scrub the interior of the hose 32. The air valve 21 remains open after the solvent valve 20 is closed to dry the inside of the hose 32 to reestablish a voltage block along the length of the hose 32.

At this time, the reservoir 22 is charged with a predetermined quantity of paint. The vent valve 42 is closed and the valves 44 and 29 are opened to apply air pressure to the upper reservoir end 28. To start painting, the valves 26, 36, 38 and 62 are opened. When the spray gun 24 is triggered on, pressurized paint flows from the reservoir 22 through the manifold 27, the hose 37, the manifold 39 and the hose 63 to the spray gun 24. While paint is being applied by the spray gun 24, the reservoir 23 is charged with the next color paint. This is achieved by opening one of the paint selection valves 14, 17, 18 or 19 and the valve 54 on the color selection manifold 15, opening the valves 52 and 47 on the first mode selection manifold 48 and opening the valve 50 and the vent valve 66 on the second mode selection manifold 51. Paint will flow from the selected source through the hose 53 into the lower reservoir end 46, while the upper reservoir end 49 is vented. When the desired quantity of paint is in the reservoir 23, the paint selection valve 14, 17, 18 or 19 and the valve 47 are closed and the dump valve 55 is opened. The solvent valve 20 and the air valve 21 are pulsed to clean and dry the interior of the hose 53. While the reservoir 23 is filled and the hose 53 is purged, the hose 58 forms a voltage block between the coil selection manifold 39, which will be at a high voltage, and the first mode selection manifold 48, which will be grounded through the paint during filling and through the solvent during cleaning.

Upon completion of spraying with paint from the reservoir 22, the high voltage at the spray gun 24 is interrupted, the valves 33, 31, 36, 38 and 60 are opened and the solvent valve 20 and the air valve 21 are briefly pulsed to clean and dry the hose 37 and the manifold 39 and the valve 62 is opened to clean and dry the hose 63 and the gun 24. At this time, the hose 37 will form a voltage block between the first mode selection manifold 27 and the coil selection manifold 39. The valves 36 and 38 are closed, the valves 26, 29 and 40 are opened, and the solvent and air valves 20 and 21 are pulsed open to clean and dry the reservoir 22. The reservoir 22 then is filled with a predetermined quantity of the next color paint. While the reservoir 22 is cleaned, dried and charged with the next color paint, the valves 68 and 50 are opened to pressurize the reservoir 23 and the valves 47, 57, 59 and 62 are opened to deliver paint from the reservoir 23 to the spray gun 24. Thus, the system 10 is capable of providing a nearly constant flow of paint in a desired color sequence to the spray gun 24. Paint flow only need be interrupted while the voltage block hose 37 or 58, the coil selection manifold 39, the spray gun hose 63 and the spray gun 24 are cleaned and dried. No wait is required for cleaning the reservoir or for charging the reservoir with the next color paint. Also, it should be appreciated that the high voltage is present only at the spray gun 24 and on the column of paint extending from the spray gun 24 to the reservoir 22 or 23 currently supplying paint to the spray gun 24. This provides a significant safety factor since it minimizes the electrical capacity and accordingly the energy stored in the high voltage portion of the system and it maintains the paint supplies at ground potential to avoid risk to personnel working in the area.

Figure 2:
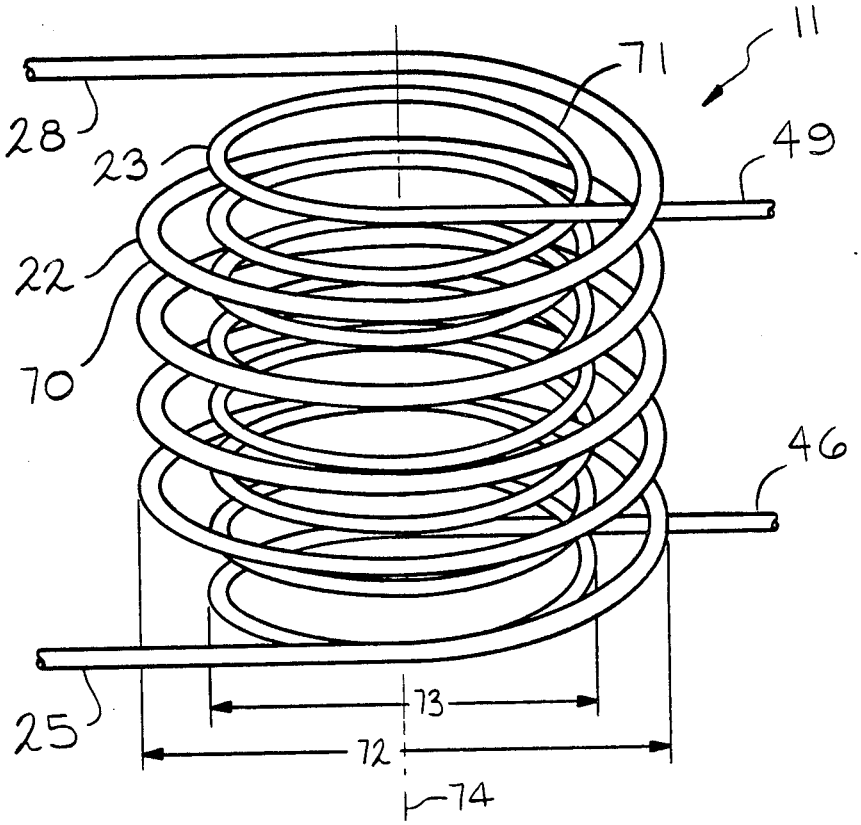
FIG. 2 is an enlarged perspective view of the dual paint reservoirs of the invention.

Turning to FIG. 2, details are shown for the reservoirs 22 and 23 forming the dual paint reservoir 11 of the invention. The reservoir 22 consists of a tube 70 and the reservoir 23 consists of a tube 71. Each tube 70 and 71 is made from an electrically insulated material capable of withstanding the very high voltages found in an electrostatic painting system, which may be on the order of 100,000 volts or more. The reservoir tube 70 is wound in a helix having a predetermined inner diameter 72. The reservoir tube 71 is wound in a helix having a predetermined outer diameter 73, which is less than the inner diameter 72. This permits coaxially mounting the reservoirs 22 and 23 about a common axis 74 with the helical reservoir tube 71 located within the helical reservoir tube 70. Preferably there is only a small difference between the diameters 72 and 73 so that the capacities of the reservoirs 22 and 23 are substantially the same. Or, the reservoir 23 may be greater in height to provide the same capacity as the larger diameter reservoir 22. By mounting the reservoir 23 coaxially within the reservoir 22, the limited space available in or adjacent the spray booth wherein the paint is applied is used more efficiently over a system having the reservoirs spaced apart on different axes.

As shown in the drawings, the helically wound reservoir tubes 70 and 71 are wound in the same direction about the axis 74. It should be appreciated that the reservoir tubes 70 and 71 also may be wound in opposite directions about the axis 74. As indicated above, the reservoirs 22 and 23 are preferably wound coaxially about the same axis. It is considered within the scope of the invention and the following claims to position a smaller diameter helically wound reservoir tube within a larger diameter helically wound reservoir tube with the axes displaced from each other.

I claim:

1. An electrostatic paint spray system including dual voltage isolating paint reservoirs comprising an electrically grounded source of different color paint and solvent, an electrostatic paint spray gun, first and second electrically insulated tubes, each of said tubes forming a separate paint reservoir electrically isolated from the other paint reservoir, each of said tubes winding about an axis to form a helix, said second tube forming a helix having an outer diameter less than the inner diameter of said first tube, said second tube helix extending within said first tube helix, means for selectively supplying paint and solvent from said source to said first and second tubes, and means for selectively delivering paint from one of said first and second tubes to said spray gun while the outer of said first and second tubes is cleaned with solvent and charged with paint from said source.

2. An electrostatic paint spray system including dual voltage isolating paint reservoirs, as set forth in claim 1, wherein said first and second tube helices are positioned coaxially.

3. An electrostatic paint spray system including dual voltage isolating paint reservoirs, as set forth in claim 2, wherein said first tube helix and said second tube helix are wound in the same direction about said axis.

* * * * *

UNITED STATES PATENT AND TRADEMARK OFFICE

CERTIFICATE OF CORRECTION

PATENT NO. : 4,884,752

DATED : December 5, 1989

INVENTOR(S) : Raymond G. Plummer

It is certified that error appears in the above-identified patent and that said Letters Patent is hereby corrected as shown below:

In Claim 1, Column 6 at line 29, "outer" should read -- other --.

Signed and Sealed this

Thirtieth Day of October, 1990

*Attest:*

HARRY F. MANBECK, JR.

*Attesting Officer*

*Commissioner of Patents and Trademarks*